United States Patent [19]

Tatomir et al.

[11] Patent Number: 4,802,234

[45] Date of Patent: Jan. 31, 1989

[54] MODE SELECTIVE BAND PASS FILTER

[75] Inventors: Paul J. Tatomir, Torrance; Martin B. Hammond, Glendora; Rolf Kich, Rendondo Beach, all of Calif.

[73] Assignee: Hughes Aircraft Company, Los Angeles, Calif.

[21] Appl. No.: 156,119

[22] Filed: Feb. 16, 1988

[51] Int. Cl.[4] ..... H01P 1/208; H01P 1/212; H01P 1/162

[52] U.S. Cl. ..... 333/211; 333/818; 333/212; 333/251; 333/228

[58] Field of Search ..... 333/202, 251, 208–212, 333/81 B, 248, 219, 227, 228

[56] References Cited

U.S. PATENT DOCUMENTS

| | | | |
|---|---|---|---|
| 3,237,132 | 2/1966 | Okaya | 333/208 X |
| 4,184,130 | 1/1980 | Nishikawa et al. | 333/202 |
| 4,500,859 | 2/1985 | Ren et al. | 333/202 |

*Primary Examiner*—Marven L. Nussbaum

*Attorney, Agent, or Firm*—Steven M. Mitchell; Mark J. Meltzer; A. W. Karambelas

[57] ABSTRACT

A microwave band pass filter for filtering electromagnetic signals has a set of cavities arranged serially, with a block of dielectric material filling each cavity to define regions of each cavity which are loaded with dielectric material and regions which are free of the dielectric material. Each cavity may be viewed as a resonator for a fundamental mode of progagation of an electromagnetic wave while each block can be viewed as a resonator for higher-order modes of propagation of electromagnetic power. The cavities are separated by walls having slots aligned with the free regions of the cavities for coupling power from the fundamental mode while minimizing interaction with power of the higher-order modes. The filter enables the construction of an enlarged passband while inhibiting the presence of the spurious higher-order modes in a stop band bordering the passband.

19 Claims, 3 Drawing Sheets

FIG. 5
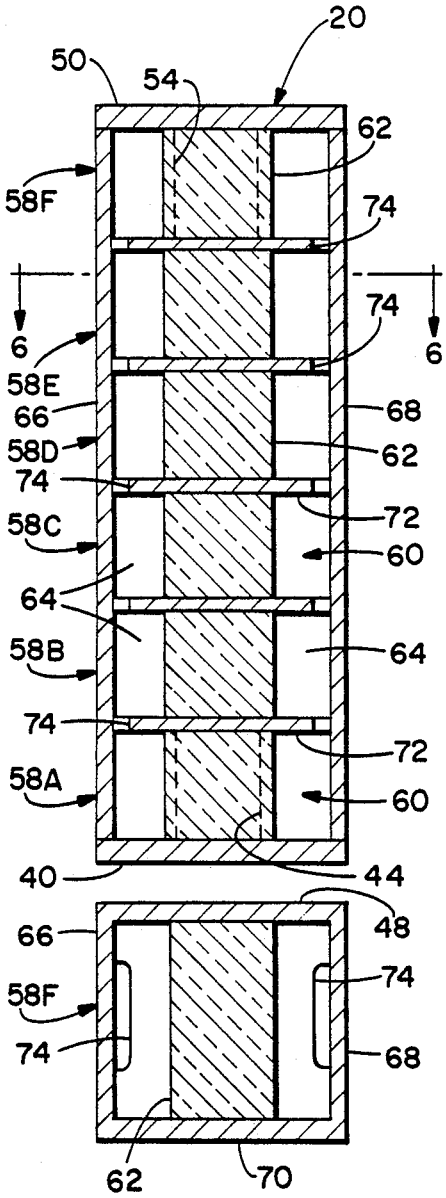
FIG. 6
FIG. 7
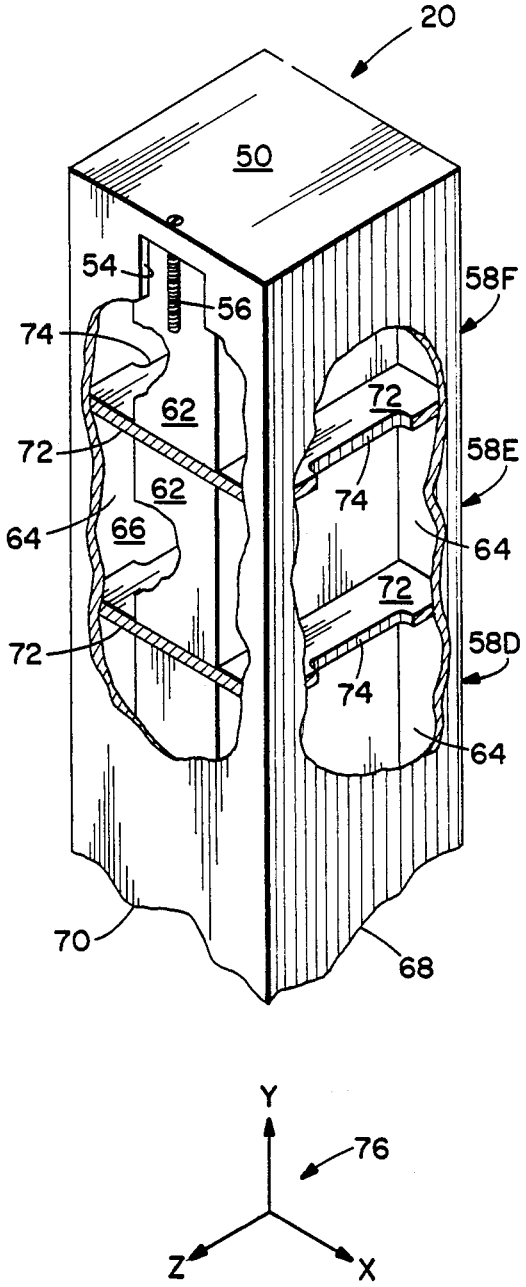

MODE SELECTIVE BAND PASS FILTER

BACKGROUND OF THE INVENTION

This invention relates to filters of microwave electromagnetic signals having at least one resonant chamber and, more particularly, to a microwave filter wherein each resonant chamber is a cavity partially loaded with a dielectric block and having coupling slots located away from the dielectric block to provide for a concentration of higher-order modes of electromagnetic waves in the block away from the coupling slots for attenuating higher-order modes outside a passband of the filter.

Microwave filters are employed frequently for processing signals. For example, a band pass microwave filter may be coupled to an antenna for reception of an incoming electromagnetic signal, the band pass filter passing signal components lying within a desired frequency band while excluding signal components lying outside of the band. A common form of construction of such filters is the use of a series of cavities formed within a metallic structure to serve as resonators, the hollow cavities being coupled via slots in walls which separate the cavities from each other.

A problem arises in the utilization of such filter structures in that electromagnetic waves introduced into such filter structures propagate by both a fundamental mode and higher-order modes. Due to the propagation of the higher-order modes, a filter having a stop band at frequencies immediately above the passband experience a transmission of signal components at still higher frequencies, which higher frequencies correspond to the frequencies of the higher-order modes. Therefore, it is a common practice in the design of microwave filters to include a further filter structure providing the function of a low pass filter having a cut-off frequency greater than the frequencies of the passband but lower than the frequencies of the higher-order modes.

While the use of the additional low pass filter structure is effective in terms of accomplishing the desired band pass filter function, the additional filter structure has a physical complexity and additional physical size to the filter assembly which is disadvantageous in microwave systems requiring a minimum overall size, such as a microwave system to be carried by a satellite. Also, the additional low pass filter may not provide as sharp cut-off frequency response as is desired for construction of an enlarged passband of the band pass filter. As a result, existing filter technology is restrictive in the available bandwidth and also necessitates undesirably large physical size, particularly for airborne and satellite communication systems.

SUMMARY OF THE INVENTION

The foregoing problem is overcome and other advantages are provided by a band pass filter formed of a plurality of serially-connected resonators and wherein, in accordance with the invention, each of the resonators is formed as a cavity surrounded by metallic, electrically-conducting walls, with each cavity being partially filled with a block of dielectric material having a dielectric constant greater than the remaining portions of the cavity. The remaining portions of the cavity may be air filled or vacuum. Coupling devices for coupling electromagnetic energy from one cavity to the next cavity are situated away from the dielectric block. Typically, the coupling devices are configured as slots disposed within a wall which separates one cavity from the next cavity.

A feature of the invention is found in the operation of the dielectric block in each cavity, which dielectric block may be viewed as a solid waveguide or solid resonator disposed within an air-filled cavity, or cavity filled with other dielectric material having a dielectric constant lower than the dielectric material of the block. The cavity and the block may be viewed as individual resonators having different frequency characteristics. In particular, the cavity is responsive to a fundamental mode of propagation of an electromagnetic wave in the sense that a wave at the fundamental frequency tends to fill the cavity with substantial uniformity of stored electromagnetic energy. In contrast, a higher-order electromagnetic wave tends to propagate primarily within the dielectric block in the sense that most of the energy of the higher-order wave is found within the dielectric block, with only a relatively small portion of the electromagnetic energy of the higher-order wave being found in regions of the cavity outside the dielectric block. This provides a mode-selective characteristic to each cavity of the filter because the fundamental mode provides for an energy distribution which is relatively uniform throughout the cavity while the energies of the higher-order modes are found primarily within the dielectric block. This permits extraction of energy from a wave at the fundamental component by means of the coupling devices located outside of the dielectric block with minimal interference from the presence of higher-order modes within the dielectric block. As a result, the invention provides for the construction of a band pass filter in which all filtering functions are performed directly within the foregoing cavities without the need for an additional low pass filter, and wherein the exclusion of higher order modes from a signal outputted by the filter can be accomplished to a desired degree of specificity by use of additional cavities, or sections, in the band pass filter.

BRIEF DESCRIPTION OF THE DRAWING

The foregoing aspects and other features of the invention are explained in the following description, taken in connection with the accompanying drawing wherein:

FIG. 5 is a sectional view of the filter taken along the 5—5 in FIG. 2;

FIG. 6 is a sectional view of the filter taken along the 6—6 in FIG. 5; and FIG. 7 is an isometric view of the an enlarged fragmentary portion of the filter of FIG. 1.

DETAILED DESCRIPTION

Figure 1:
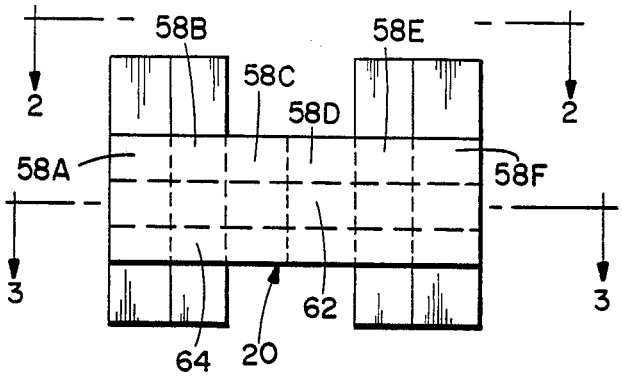
FIG. 1 is a plan view of the filter of the invention including waveguide structures appended to end sections of the filter for the introduction and extraction of electromagnetic signals, the figure being taken along line 1—1 in FIG. 2 and further showing phantom lines in the filter to identify the locations of individual cavities and compartments thereof.
Figure 2:
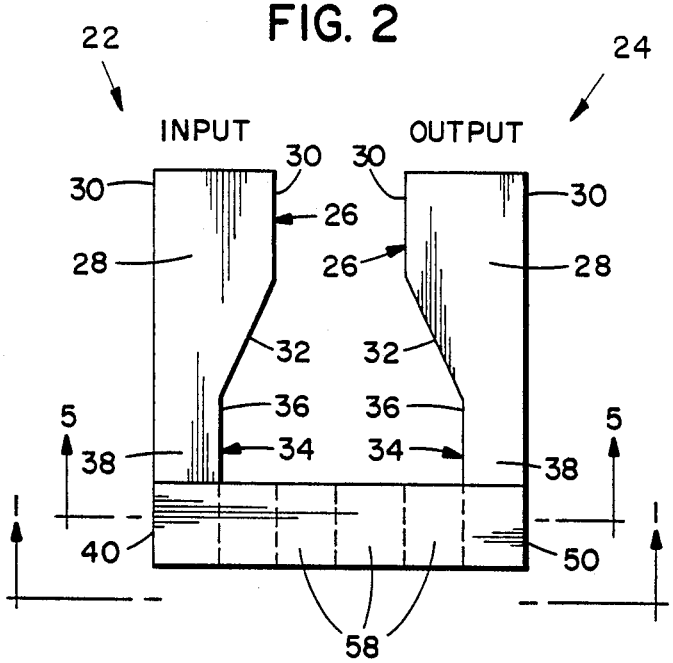
FIG. 2 is a side elevation view of the filter taken along the line 2—2 in FIG. 1.

With reference to FIGS. 1 and 2, there is shown a filter 20 constructed in accordance with the invention and disposed between an input waveguide assembly 22 and an output waveguide assembly 24. Each of the waveguide assemblies 22 and 24 comprises a waveguide 26 of rectangular cross section having four sidewalls wherein two of the sidewalls are narrow walls 28 and two of the sidewalls are broad walls 30 joined together by the narrow walls 28. The width of the broad wall 30 is twice the width of a narrow wall 28. The waveguide 26 is joined by a transition 32 to a waveguide 34 which is also of rectangular cross section and has broad walls 36 joined by narrow walls 38. The width of the narrow walls 38 is one-half the width of the narrow walls 28. Each of the waveguide assemblies 22 and 24 is operative with an electromagnetic wave in the $TE_{10}$ mode wherein the electric field is perpendicular to the broad walls 30. Each of the waveguide assemblies 22 and 24, by virtue of the transition 32, provides for an impedance match between the waveguides 26, which is of a standard size such as WR 75, and the filter 20.

With reference to FIGS. 1–7, the input waveguide assembly 22 terminates in a front wall of an end cavity, at an end wall 40 of the filter 20, and defines an input port 42 to the filter 20. The input port 42 includes an aperture 44 of rectangular shape in a front wall of the filter 20, there being a tuning screw 46 extending partway transversely across the aperture 44 parallel to a back wall 48 of the filter 20. Similarly, the output waveguide assembly 24 terminates in a front wall of an end cavity, at an end wall 50 of the filter 20, and defines an output port 52 of the filter 20. The output port 52 comprises an aperture 54 of rectangular configuration in the front wall of the filter 20, there being a tuning screw 56 extending partway transversely across the aperture 54 parallel to the back wall 48 of the filter 20. Both tuning screws 46 and 56 are parallel to a longitudinal axis of the filter 20. The input port 42 applies the $TE_{10}$ mode of electromagnetic waves to the filter 20 wherein the wave is transformed to a family of waves in a fundamental mode plus higher-order modes as will be described hereinafter. At the output port 52, a fundamental mode of wave in the filter 20 is coupled out of the filter 20 to appear as a $TE_{10}$ mode in the waveguide 34 and 26 of the output waveguide assembly 24. By way of alternative embodiments either one of the ports 42, 52 may be connected via the back wall instead of the front wall. It is noted that both the input port 42 and the output port 52 have the same physical structure, both of these ports being shown in FIG. 3 while the output port 52 is shown also in FIGS. 4 and 7.

In accordance with the invention, the filter 20 comprises a set of resonator assemblies 58, six such assemblies being shown by way of example, with individual ones of the resonator assemblies being further identified by the legends 58A–58F. The assembly 58A abuts the input port 42 and the assembly 58F abuts the output port 52. Each of the resonator assemblies 58 comprises a cavity 60 and a block 62 of dielectric material disposed within the cavity 60 and partially filling the cavity 60 so as to define at least one region of the cavity 60 which is loaded with dielectric material and at least one region within the cavity 60 which is free of the dielectric material. By way of example in the construction of the resonator assemblies 58, only one loaded region is shown, the loaded region being the block 62 itself, two of the free regions being shown at 64 in FIGS. 5, 6, and 7.

The compartmentalization of the filter 20 into a set of individual resonator assemblies 58, each of which includes a block 62 of dielectric material and two regions 64 free of the material are indicated in FIGS. 1 and 2 by phantom lines.

The filter 20 is constructed of walls of electrically conducting material, such as aluminum or brass, these walls including the back wall 48, two sidewalls 66 and 68, the front wall 70, and separator walls 72 which define cavities 60 of the resonator assemblies 58B–58E. The cavity 60 of the resonator 58A is closed off by the end wall 40, and the cavity 60 of the resonator assembly 58F is closed off by the end wall 50. Each of the cavities 60 has the same physical shape in the preferred embodiment of the invention for construction of a sixth order Chebyshev filter, it being understood that the principles of the invention are also applicable to filters constructed with cavities which may be varied in their dimensions to produce specific filter characteristics.

Figure 3:
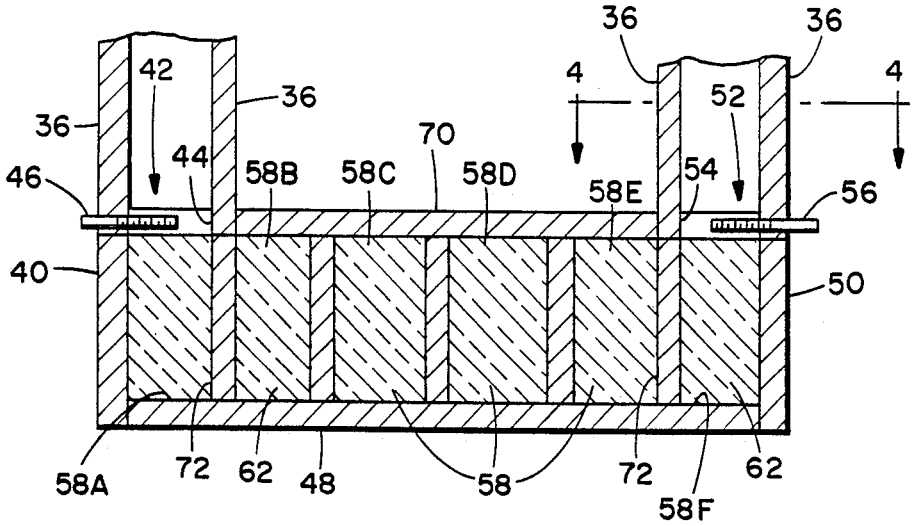
FIG. 3 is a sectional view of the filter including adjoining portions of the waveguide structures taken along the line 3—3 in FIG. 1.
Figure 4:
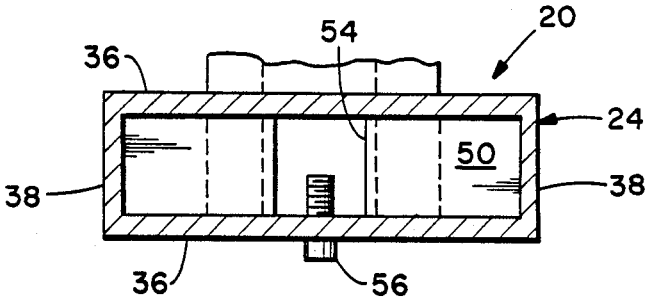
FIG. 4 is a sectional view of a portion of the filter assembly of FIG. 1 taken along the line 4—4 in FIG. 3 to show a coupling aperture by which electromagnetic energy is coupled between a waveguide structure and a cavity of the filter.

As best shown in FIGS. 3 and 5, the six cavities are disposed in a serial arrangement wherein coupling of electromagnetic power from one cavity to the next cavity is accomplished by means of coupling devices in the form of slots 74 (FIG. 5) located in the separator walls 72 next to the sidewalls 66 and 68. While other forms of coupling devices, such as probes (not shown) responsive to electric fields may be employed, the preferred embodiment of the invention employs the slots 74 which are responsive to the magnetic fields of electromagnetic waves propagating through the cavities 60. The slots 74 are positioned substantially at the locations of maximum strength of the magnetic fields of the foregoing electromagnetic waves to maximize the coupling of electromagnetic power from the cavity to the next cavity. It is noted that the electric field strength has a minimum value, essentially zero, at the locations of the slots 74 because of the proximity to the sidewalls 66 and 68. It is possible, by way of alternative embodiment (not shown), to split the dielectric blocks 62 into two portions, with one portion being contiguous the sidewall 66 and the other portion being contiguous the sidewall 68, in which case there would be one free region 64 in the center of each cavity 60. In such case, coupling probes responsive to electric fields of the electromagnetic waves would be positioned in the centers of the separator walls 72 for coupling electromagnetic power because the centers of the separator walls 72 experience the maximum strength of the electric field of the electromagnetic waves.

In operation, an electromagnetic wave entering the input port 42 induces electromagnetic waves within the resonator assembly 58A wherein the fundamental mode is a $TE_{101}$ wave and two of the higher-order modes are $TE_{102}$ and $TE_{103}$ waves, the x, y and z components of the electromagnetic waves being indicated by a coordinate system 76 appended adjacent the end of the filter 20 in FIG. 7. In the preferred embodiment of the invention, the nominal frequency of operation of the filter 20, 12 GHz (gigahertz), and the corresponding dimension of each of the cavities 60 are 0.4 by 0.4 by 0.2 inches respectively in the x, z, and y dimensions. With reference to the coordinate system 76, the x dimension represents a width of a cavity 60, this being from left to right as viewed in FIG. 5. The z dimension represents the depth of a cavity 60, this being the up and down dimension shown in FIG. 3. The y dimension represents the height of a cavity 60, this being the spacing between successive separator walls 72 in FIGS. 3 and 5 along a direction of propagation of electromagnetic waves between the input port 42 and the output port 52. With reference to the foregoing dimensions of a cavity 60, the $TE_{101}$ wave shows one half sinusoid in the expanse between sidewalls 66 and 68, and one half sinusoid in the expanse between the front wall 70 and the back wall 48. In the higher-order modes, additional half sinusoids appear, the frequencies of the higher-order modes being significantly greater than the frequency of the fundamental mode. In still higher frequencies, at least double that of the fundamental mode, in the absence of the block 62, modes such as a $TE_{201}$ and a $TE_{202}$ mode may appear. The presence o dielectric material, such as quartz, in a preferred embodiment of the block 62 greatly increases the frequency of the modes $TE_{201}$ and $TE_{202}$ by a factor in the range of 2 to 10 as compared to the frequency of the fundamental mode $TE_{101}$, the multiplicative factor depending on the dimensions of the block 62 and the difference in dielectric constant between the material of the block 62 and the air or other material, if desired, in the free regions 64 of a cavity 60. However, in the range of frequencies of interest, there are no sinusoidal variations in the y direction, this being along a longitudinal axis of the filter 20, because the y dimension or height is substantially less than either of the transverse dimensions of width and depth. As noted above, the height is only half of the transverse dimensions in the preferred embodiment of the invention. If desired, the height can be reduced still further relative to the transverse dimensions.

In the preferred embodiment of the invention, the block 62 in a cavity 60 extends the full height of the cavity 60 along the y dimension. The width of the block 62, as measured in the x dimension, is approximately one-half the width of the cavity 60. The depth of the block 62, as measured in the z dimension, is equal to the depth (apart from clearance utilized to facilitate manufacture) of the cavity 60. Thus, in the preferred embodiment of the invention, a block 62 measures 0.2 by 0.2 by 0.4 inch, respectively in the x, y, and z dimensions.

Each of the cavities 60 may be viewed as a section of hollow waveguide, and the block 62 may be viewed as a section of solid waveguide. Alternatively, each cavity 60 may be viewed as a hollow resonator and the block 62 therein may be viewed as a solid resonator. Due to the smaller dimensions of the block 62, as compared to the dimension of the cavity 60, the block 62 induces resonance and standing waves of the shorter-wavelength, higher-frequency modes of electromagnetic waves than does the cavity 60. The composite structure of the cavity 60 and the block 52 in each of the resonator assemblies 58 introduces a nonlinear operation to the resonator assemblies 58 such that the location of the energy of a mode of propagation of an electromagnetic wave depends on the frequency and wavelength of the mode. With the foregoing dimensions of the block 62, more of the electromagnetic energy appears in the dielectric material of the block 62 for all of the modes than appears in the air of the regions 64 which are free of the dielectric material. However, in the case of the fundamental mode, 60% of the energy appears in the region of the cavity 70 loaded with the dielectric material, namely the block 62, while 40% of the energy of the fundamental mode appears in the region 64 of the cavity 60 which is free of the dielectric material. In contrast, with respect to the higher-order modes, at least 95% of the energy of the electromagnetic waves appears in the dielectric loaded regions of the activity 60 while only 5% of the energy appears in the free regions 64. This gives a ratio of 8:1 between the energy stored in the magnetic fields of the fundamental mode relative to the higher-order modes at the locations of the slots 74. The difference in stored energy provides a frequency selectivity to the coupling functions of the slots 74 in that the slots 74 couple primarily energy of the fundamental mode with relatively little energy being coupled in the frequency bands in the higher-order modes. This provides the filter 20 with the desired band pass characteristics in which the stop band at frequencies higher than those of the passband is substantially free of the presence of resonances at the frequencies of the higher-order modes.

With respect to the construction of the input port 42 and the output port 52, in the preferred embodiment of the invention, the apertures 44 and 54 have a generally square shape measuring in the range of 150 to 200 mils on a side. This dimension is slightly less than the width of the block 62, as is shown in FIG. 5. This dimension of a side of the aperture is substantially less than the depth of the block 62 as is indicated in the sectional view of FIG. 3. Therefore, the aperture 44 and the aperture 54 each open fully into a block 62. The centering of the apertures 44 and 54 in the x dimension promote a uniform illumination of the resonator assembly 58A and extraction of power from the resonator assembly 58F, respectively, this uniformity being enhanced by the illumination and extraction totally within a cavity region of one dielectric material.

By way of further example in the construction of a preferred embodiment of the filter 20, the block 62 is formed of a ceramic dielectric material having a dielectric constant of 4, the filter 20 has a 500 MHz(megahertz) bandwidth in a sixth order Chebyshev passband. This is accomplished with overall dimensions of the filter 20 of 1.5 inches in length by 0.5 inches in width by 0.5 inches in depth, at a center frequency of 12 GHz. Greater than 60 dB (decibels ) rejection is obtained in a stop band from 13 to 23 GHz. From 23 to 26 GHz, the rejection is 30 dB.

Thus, the foregoing description teaches the construction of a compact band pass filter in which higher-order spurious modes of electromagnetic propagation are significantly attenuated by virtue of the frequency-selective operation of the serially arranged sections of the filter wherein the use of a composite dielectric structure introduces a separation of the energies of the fundamental and the higher-order modes. While quartz, or ceramic, and air have served as the two types of dielectric material, any other two types of dielectric material having significantly different dielectric constants and low loss to the propagation of electromagnetic waves may be employed. Advantage is taken of the separation of the energies of the different modes by placing the coupling devices in the region of each of the filter sections containing the energy of the mode which is desired to be coupled through the filter By coupling the fundamental mode, the spurious higher-order modes are deleted substantially from an output signal of the filter.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A filter comprising:

a plurality of cavities arranged in series;

means for coupling electromagnetic power from one of said cavities to a succeeding one of said cavities in said series of cavities;

a plurality of blocks of dielectric material, one of said blocks being disposed in each of said cavities, each of said blocks being smaller than the volume of the cavity containing the block to define at least one region free of the dielectric material having relatively low dielectric constant and at least one region of relatively high dielectric constant loaded with the dielectric material in each cavity; and wherein said blocks are positioned within their respective cavities for interacting with higher-order modes of propagation of electromagnetic waves above a fundamental mode, thereby to increase attenuation of frequency components of said higher-order modes which may be present in a microwave signal.

2. A filter according to claim 1 wherein said cavities are arranged adjacent one another, adjacent ones of said cavities being separated by a common wall, said coupling means comprising slots disposed in said common wall.

3. A filter according to claim 2 wherein said slots are located in said free region of a cavity.

4. A filter according to claim 3 wherein said block in each of said cavities is bounded by flat surfaces, a slot in said free region being parallel to a surface of said block facing said slot.

5. A filter according to claim 4 wherein said fundamental mode has a greater energy content in said free region of a cavity than do said higher-order modes, and wherein a slot in one of said cavities is located substantially at a location of maximum magnetic field strength of an electromagnetic wave at said fundamental mode, said slot being parallel to the magnetic field.

6. A filter according to claim 3 wherein said fundamental mode has a greater energy content in said free region of a cavity than do said higher-order modes, and wherein a slot in one of said cavities is located substantially at a location of maximum magnetic field strength of an electromagnetic wave at said fundamental mode, said slot being parallel to the magnetic field.

7. A filter according to claim 6 wherein said filter has an input port and an output port, the series of said cavities extending from said input port to said output port to provide for the propagation of an electromagnetic signal from said input port to said output port, each of said cavities being formed as a rectangular parallelepiped having dimensions of width and depth which are transverse to the direction of propagation of an electromagnetic signal between said input port and said output port, each of said parallelepipeds having a height extending in the direction of propagation of said electromagnetic signals, said dimensions of width and depth being sufficiently long to sustain said fundamental mode and said higher-order modes, said dimension of height being reduced relative to said width and to said depth to inhibit formation of a component of a mode of wave propagation along the height dimension.

8. A filter according to claim 7 wherein the coupling of electromagnetic power by one of said slots is accomplished by the coupling of power between the free regions of two adjacent cavities.

9. A filter according to claim 7 wherein said input port couples to a loaded region of a first cavity of said series, and said output port couples to a loaded region of a last cavity of said series.

10. A filter according to claim 9 wherein said input port and said output port are each configured as a rectangular waveguide terminated by a shorting end wall, there being an aperture in said end wall connecting a waveguide to a cavity of said series of cavities, thereby to illuminate uniformly said cavity with electromagnetic power at said fundamental mode while injecting higher-order modes directly into said dielectric block.

11. A filter according to claim 7 wherein, in each of said cavities, said transverse dimensions of width and depth are substantially equal, and wherein said height dimension is approximately one-half the length of a transverse dimension, and wherein said block extends along said depth dimension and is configured as a rectangular parallelepiped having end surfaces of substantially square cross section extending the full height of the cavity, side surfaces of said block extending the full depth of the cavity.

12. A filter according to claim 11 wherein said dielectric material is quartz.

13. A filter according to claim 1 wherein a relatively large fraction of the energy of an electromagnetic wave in said fundamental mode is present in a free region of each of said cavities, and a relatively small fraction cf the energy carried by said higher order modes of electromagnetic waves is present in said free region of each of said cavities, said coupling means coupling the power from a free region of one of said cavities to a free region of a second of said cavities, thereby to isolate energy of a higher order mode from energy of the fundamental mode.

14. A filter according to claim 13 wherein said filter has an input port and an output port, the series of said cavities extending from said input port to said output port to provide for the propagation of an electromagnetic signal from said input port to said output port, each of said cavities being formed as a rectangular parallelepiped having dimensions of width and depth which are transverse to the direction of propagation of an electromagnetic signal between said input port and said output port, each of said parallelpipeds having a height extending in the direction of propagation of said electromagnetic signals, said dimensions of width and depth being sufficiently long to sustain said fundamental mode and said higher-order modes, said dimension of height being reduced relative to said width and to said depth to inhibit formation of a component of a mode of wave propagation along the height dimension.

15. A filter comprising:

a serial arrangement of resonator assemblies each of which includes an outer resonator having a cavity, and an inner resonator located in said cavity;

means for coupling electromagnetic power from the outer resonator in one assembly of said serial arrangement to the outer resonator of a next assembly on said serial arrangement;

input means for inputting electromagnetic power to a first one of said resonator assemblies, said electromagnetic power being divided among a fundamental mode and higher-order modes of propagation of electromagnetic waves in said resonator assemblies, said inner and said outer resonators separating said fundamental mode from said higher-order modes to place said higher-order modes primarily in said inner resonators and said fundamental mode primarily in said outer resonators to enable coupling of energy of said fundamental mode by said coupling means; and output means for outputting energy of the fundamental mode from a last one of said resonator assemblies substantially unimpeded with energy of a higher-order mode.

16. A filter according to claim 15 wherein each of said inner resonators is formed as a block of dielectric material disposed in a corresponding one of said outer resonators.

17. A filter according to claim 16 wherein, in each of said outer resonators, the cavity is formed as a rectangular parallelepiped cavity bounded by walls of electrically conductive material, the cavity having dimensions of width and depth disposed transverse to a direction of propagation of electromagnetic power between said input means and said output means, each of said parallelepiped cavities having a dimension of height measured in a direction parallel to said direction of propagation of electromagnetic power, the transverse dimensions of width and depth having sufficient length to sustain said fundamental mode and said higher-order modes, and said dimension of height being sufficiently smaller than the transverse dimensions to inhibit a mode of propagation having a component along the height dimension.

18. A filter according to claim 17 wherein, in each of said cavities, said transverse dimensions of width and depth are substantially equal, and wherein said height dimension is approximately one-half the length of a transverse dimension, and wherein said block extends along said depth dimension and is configured as a rectangular parallelepiped having end surfaces of substantially square cross section extending the full height of the cavity, side surfaces of said block extending the full depth of the cavity; and wherein the dielectric constant of said block of dielectric material is greater than the dielectric constant of a remaining portion of the cavity outside said block.

19. A filter according to claim 18 wherein said cavities are arranged adjacent one another, adjacent ones of said cavities being separated by a common wall, said coupling means comprising slots disposed in said common wall; and wherein said slots are located away from said block of dielectric material in a region having substantially a maximum value of magnetic field of the fundamental mode of electromagnetic wave.

* * * * *

UNITED STATES PATENT AND TRADEMARK OFFICE

CERTIFICATE OF CORRECTION

PATENT NO. : 4,802,234

DATED : January 31, 1989

INVENTOR(S) : TATOMIR et al.

It is certified that error appears in the above-identified patent and that said Letters Patent is hereby corrected as shown below:

[57] Abstract: line 7 delete "progagation" and insert --propagation-.

Column 1, line 48, before "cut-off" insert -- a --.

Column 6, line 61, after "filter" insert a period -- . --.

Column 8, line 30, delete "cf" and insert --of--.

Signed and Sealed this

Eighteenth Day of July, 1989

*Attest:*

*Attesting Officer*

DONALD J. QUIGG

*Commissioner of Patents and Trademarks*